United States Patent [19]

Fukuoka

[11] Patent Number: 4,468,869

[45] Date of Patent: Sep. 4, 1984

[54] FOOTWEAR

[76] Inventor: Sadao Fukuoka, 3-4, 2-chome, Shinminami-Fukushima, Tokushima-shi, Tokushima-ken, Japan

[21] Appl. No.: 479,440

[22] Filed: Mar. 28, 1983

[30] Foreign Application Priority Data

Oct. 26, 1982 [JP] Japan ..... 57-160992[U]

[51] Int. Cl.[3] ..... A43B 7/06

[52] U.S. Cl. ..... 36/3 B; 36/3 R; 36/29

[58] Field of Search ..... 36/3 R, 3 A, 3 B, 29, 36/28

[56] References Cited

U.S. PATENT DOCUMENTS 863,873 8/1907 Pratt ..... 36/3 B 2,356,490 8/1944 Crotty ..... 36/3 A

FOREIGN PATENT DOCUMENTS 460893 6/1928 Fed. Rep. of Germany ..... 36/3 R

*Primary Examiner*—Werner H. Schroeder
*Assistant Examiner*—Tracy Graveline
*Attorney, Agent, or Firm*—Edward F. Levy

[57] ABSTRACT

Disclosed is an article of footwear such as a shoe having an inner sole and outer sole which delimit a vacant space of a predetermined height between them, the inner sole having a plurality of ventilating holes for communicating the vacant space with the interior of the shoe. A cushion member made of a light-weight, resilient material is disposed within the vacant space at the forward part of the shoe and has a plurality of elongated ribs spaced apart by a predetermined distance and extending to the rear portion of the vacant space. Each elongated rib has at least one recessed portion passing through the rib substantially laterally thereof to communicate with the spaces on either side of the rib. Compression and relaxation of the cushion member with the application and removal of the wearer's weight during walking creates a circulatory air flow to ventilate the interior of the article of footwear.

3 Claims, 5 Drawing Figures

FOOTWEAR

BACKGROUND OF THE INVENTION

This invention relates to an article of footwear, such as a shoe, so adapted as to permit ventilation of the interior of the footwear.

Various footwear configurations designed to promote ventilation of the interior of the article of footwear are known in the art. A typical article of such footwear, such as a shoe, includes an outer sole and inner sole delimiting a vacant space between them, hollow pump members made of a flexible material disposed in the vacant space at the toe end of the shoe, and supporting bodies also disposed in the vacant space for maintaining the shape thereof. Each pump member has an upper surface provided with air intake holes, and a rear portion provided with air discharge holes. The inner sole is provided with ventilating holes for communicating the air within the vacant space with the air inside of the shoe proper. When the weight of the wearer is applied to the shoe as the wearer walks, the inner sole is deformed downwardly to compress the pump members while the wearer's foot blocks the air intake holes formed in the pump members. Consequently, the air enclosed within the pump members is expelled into the rear portion of the shoe from the air discharge holes. The expelled air exits from the shoe from the area surrounding the wearer's angle by passing through the ventilating holes formed in the inner sole. As the wearer continues to walk and the shoe is lifted from the ground, the wearer's weight is removed from the shoe so that the pump members relax back to their original shape owing to their restorability. This causes the air in the vacant space between the inner and outer soles to be drawn in through the air intake holes, as well as the air in the shoe interior, which passes through the ventilating holes formed in the inner sole. Thus, the arrangement is such that the air within the shoe is ventilated by means of a circulatory air flow.

Although the shoe of the aforementioned construction is ventilated in the desired fashion, the shoe does have certain disadvantages. Specifically, the fact that several individual pump members and supporting members are disposed in the vacant space between the inner and outer soles results in a shoe which is complicated in construction, laborious to manufacture and, hence, high in cost. Since the pump members are required to have structural strength, moreover, it is necessary to use materials which are of considerable weight. This results in a heavy shoe which is uncomfortable to wear.

SUMMARY OF THE INVENTION

Accordingly, an object of the present invention is to provide an article of footwear the interior whereof is well ventilated, the article of footwear being easy to manufacture at reduced cost owing to a simple construction.

Another object of the present invention is to provide an article of footwear the interior whereof is capable of being ventilated, and which is light in weight and, hence, comfortable to wear.

According to the present invention, these and other objects are attained by providing an article of footwear having an inner sole and an outer sole delimiting a vacant space between them, and a cushion member made of a light-weight, resilient material disposed in the vacant space. The inner sole is provided with a plurality of ventilating holes for communicating the vacant space with the interior of the article of footwear, and the cushion member includes a plurality of elongated ribs having a predetermined spacing between them and extending up to the vicinity of the arch portion of the article of footwear. The elongated ribs are provided with recessed portions of a prescribed depth approximately in line with the ventilating holes and passing completely through the elongated ribs. Compression and relaxation of the cushion member with the application and removal of the wearer's weight during walking creates a circulatory air flow to ventilate the interior of the article of footwear.

Other features and advantages of the invention will be apparent from the following description taken in conjunction with the accompanying drawings in which like reference characters designate the same or similar parts throughout the figures thereof.

DESCRIPTION OF THE PREFERRED EMBODIMENT

Figure 1:
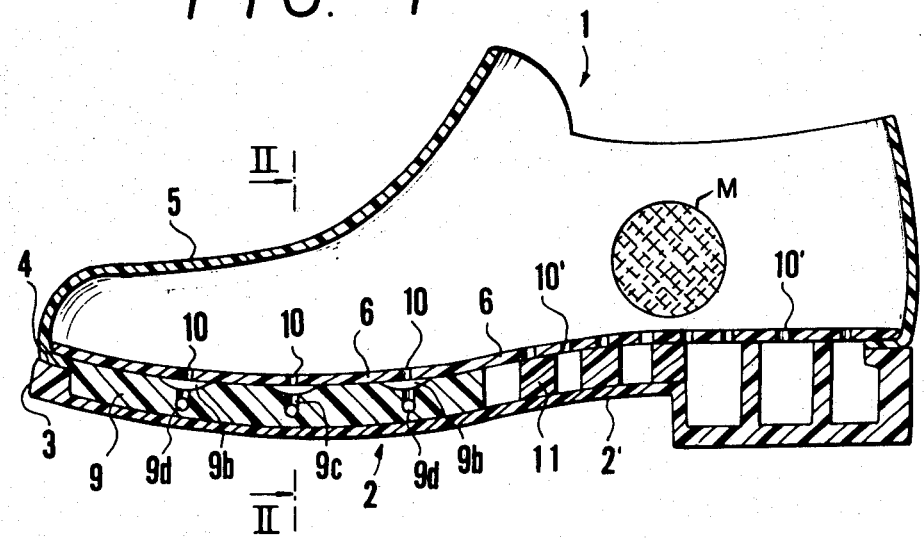
FIG. 1 is a side section illustrating an embodiment of an article of footwear according to the present invention.

Referring now to FIGS. 1 through 4, an article of footwear (hereinafter referred to as a shoe) 1 constructed in accordance with the present invention includes an outer sole 2 which has an upstanding portion 3 of a prescribed height formed on the peripheral portion thereof, as well as a flange portion 4 formed at the upper part of the upstanding portion 3. The outer sole 2 also includes an arch supporting portion 2'. The outer sole 2 consists of a resilient material such as vinyl chloride, synthetic rubber, urethane or the like. The shoe 1 has an upper 5 the lower edge whereof has its outer surface inseparably adhered to the flange portion 4 of the outer sole 2. An inner sole 6 is affixed to the lower edge of the upper 5 on the inner side thereof. Thus, the outer sole 2 and inner sole 6 are affixed to each other and delimit a vacant space between them of a prescribed height decided by the height of the upstanding portion 3.

Figure 2:
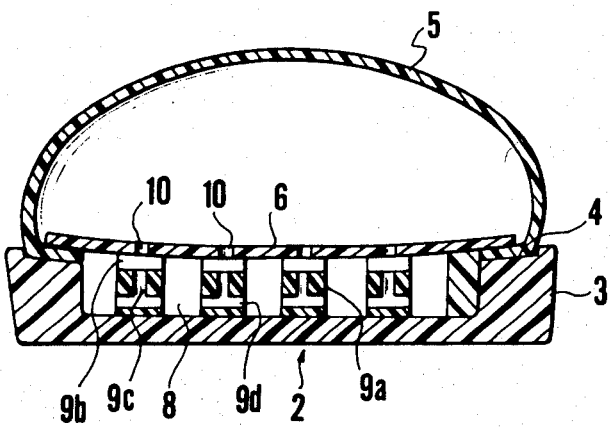
FIG. 2 is a sectional view taken along the line II-II of FIG. 1.
Figure 3:
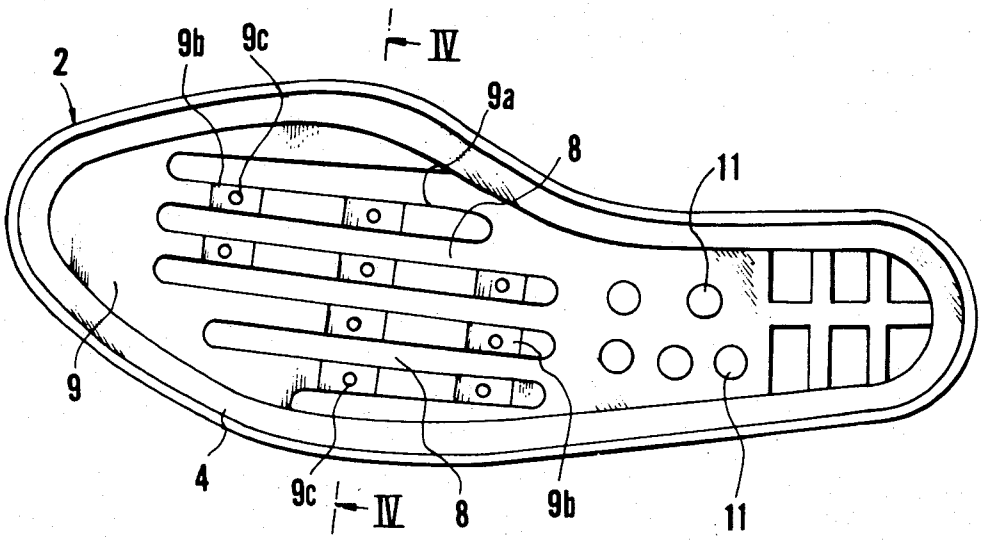
FIG. 3 is a plan view illustrating the arrangement on the inner side of an outer sole constituting the article of footwear shown in FIG. 1.
Figure 4:
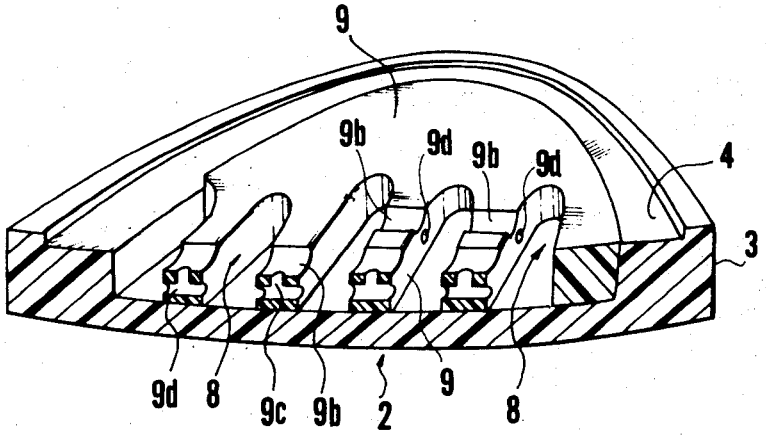
FIG. 4 is a sectional perspective view illustrating the construction of an outer sole and cushion member constituting the article of footwear of FIG. 1.

A cushion member 9 comprising a resilient body of a comparatively light-weight material is received on the outer sole 2 so as to be located at the forward part of the shoe within the vacant space formed between the outer and inner soles. As shown by the hatched portions in FIG. 3, the cushion member 9 is formed to include a plurality of elongated ribs 9*a* spaced apart by a predetermined distance and extending from the front or toe part of the outer sole 2 up to approximately the arch supporting portion 2' at the rear part of the outer sole 2. As shown in FIGS. 1 and 2, the height of the cushion member 9 is such that the upper surface thereof abuts against the lower surface of the inner sole 6. Owing to the above construction, the cushion member 9 applies a restoring force between the outer sole 2 and inner sole 6, with adjacent ones of the elongated ribs 9*a* thereof delimiting air chambers 8 between the inner and outer soles.

Each of the elongated ribs 9*a* is provided at predetermined positions with a plurality of laterally extending recessed portions 9*b* of arcuate shape when viewed in section, as illustrated in FIG. 1. The recessed portions 9*b* open into the air chambers 8 on either side of the elongated ribs 9*a*. Each elongated rib 9*a* is formed to include, at each recessed portion 9*b* thereof, a vertical bore 9*c* extending downwardly from and communicating at its upper end with the recessed portion 9*b*, and a lateral passage 9*d* communicating with the lower end of the vertical bore 9*c* and passing through the elongated rib 9*a* laterally thereof so as to open into the air chambers 8 on either side of the elongated rib 8*a*. Thus, the air chambers 8 defined by the elongated ribs 9*a* are communicated with one another laterally of the shoe via the recessed portions 9*b*, vertical bores 9*c* and lateral passages 9*d*.

The inner sole 6 is provided with ventilating holes 10 at portions thereof corresponding to the recessed portions 9*b* of the cushion member 9, and substantially in line with the vertical bores 9*c*. The inner sole 6 is further provided with second ventilating holes 10' in that portion thereof rearwardly of the cushion member 9. Thus the interior of the shoe 1 at the forward portion thereof is communicated with the air chambers 8 via the ventilating holes 10 in the inner sole 6, and the recessed portions 9*b*, vertical bores 9*c* and lateral passages 9*d* of the cushion member 9. Further, the interior of the shoe 1 at the rearward portion thereof is communicated, via the second ventilating holes 10', with the rearward part of the vacant space formed between the outer sole 2 and inner sole 6.

Intermediate members 11, each consisting of a resilient material similar to that of the cushion member 9, are provided between the outer sole 2 and inner sole 6 at the rearward part of the vacant space formed between the inner and outer soles. The intermediate members 11 serve to maintain the inner sole 6 at the prescribed height above the outer sole 2, and may be formed integral with the outer sole 2.

When the shoe 1 worn by an individual makes contact with the ground as the individual walks and the individual's weight comes to bear on the forward part of the outer sole 2, the inner sole 6 is depressed and causes the entire cushion member 9 to be compressed while the lateral passages 9*d* in the elongated ribs 9*b* of the cushion member are squeezed shut under the applied pressure. Owing to the compression of the cushion member 9, the air chambers 8 formed between the adjacent elongated ribs 9*b* of the cushion member are forcibly decreased in volume so that the air prevailing within these chambers is expelled rearwardly towardly the arch supporting portion 2' and heel portion of the shoe 1. Since the ventilating holes 10 in the inner sole 6 will be blocked off by the underside of the wearer's foot at this time, the air within the air chambers 8 can be expelled in good order in the manner described. The air expelled into the rear part of the shoe from the air chambers 8 enters the interior of the shoe proper by passing through the ventilating holes 10' and then exits from the shoe through the gap at the wearer's ankle. It should be noted that the interior portion of the shoe adjacent the arch portion 2' provides a large space for exchanging the air within the shoe with the air outside. The part of the upper 5 adjacent the arched portion 2' of the shoe 1 is therefore provided with an air-permeable portion M consisting of a meshed material or the like, as shown in FIG. 1, in order to facilitate the discharge of air from the shoe interior.

As the wearer continues to walk and the shoe 1 is lifted from the ground, the wearer's weight is removed from the shoe so that the compressive force applied to the cushion member 9 by the inner sole 6 vanishes. The inner sole 6 is restored to its original position, accompanied by the cushion member 9 which relaxes back to its original shape owing to its own restorability. The restoration of the cushion member 9 is in turn accompanied by expansion of the vacant spaces formed between the outer sole 2 and inner sole 6, creating a sucking force which draws the old air residing in the shoe interior into the air chambers 8 through the ventilating holes 10 of the inner sole 6 and the recessed portions 9*b*, vertical bores 9*c* and lateral passages 9*d* of the elongated ribs 9*a*. At the same time, air external to the shoe 1 is drawn into the shoe from the gap around the wearer's ankle and from the air permeable portion of the mesh M, and thence into the spaces between the inner and outer sole via the ventilating holes 10'. Note that the air drawn into the air chambers 8 circulates through the recessed portions 9*b* and lateral passages 9*d* of the elongated ribs 9*a*.

It will be appreciated that the expellation and intake of air as described above are repeated with continued walking, so that the old air residing within the shoe 1 is constantly circulated and exchanged with fresh air outside the shoe.

Figure 5:
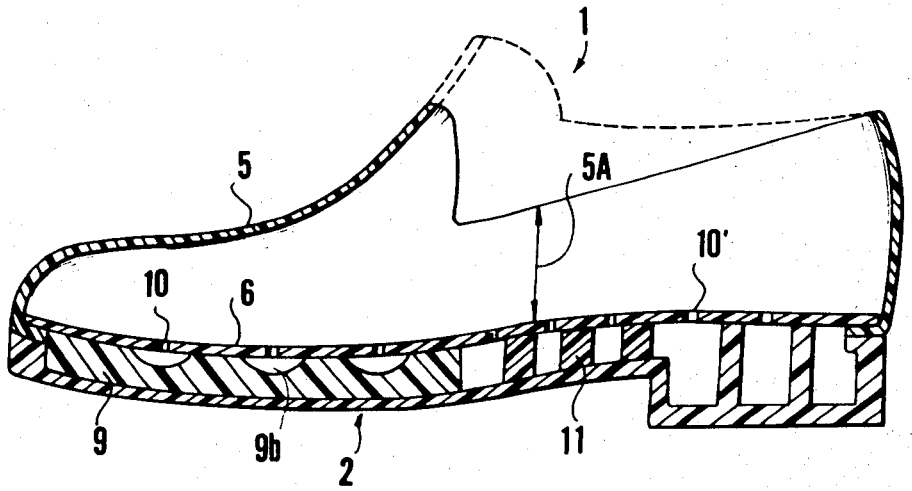
FIG. 5 is a side section illustrating another embodiment of an article of footwear according to the present invention.

In the embodiment described and illustrated hereinabove, the elongated ribs 9*a* of the cushion member 9 are formed to include the recessed portions 9*b*, and are further provided with the vertical bores 9*c* and lateral passages 9*d* communicating with the recessed portions. It should be noted, however, that the cushion member 9 need have only the recessed portions 9*b*, so that it is not absolutely necessary to provide the vertical bores 9*c* and lateral passages 9*d*. Though an arrangement relying solely upon the recessed portions 9*b* will exhibit a somewhat diminished ventilating effect in comparison with the illustrated embodiment having the bores 9*c* and passages 9*d*, almost the same ventilating effect can be achieved through the above-described operation by forming the recessed portions 9*b* to a sufficient depth. FIG. 5 is a side section illustrating such an embodiment of the invention, where it will be seen that the recessed portions 9*b* are formed to considerable depth, making it possible to dispense with the vertical bores and lateral passages of the first embodiment. Also, in FIG. 5, good ventilation can be obtained even without the provision of a mesh or other air-permeable portion M, included for ventilation purposes in the embodiment of FIG. 1, providing that the shoe 1 is of the type having a wide opening with upper 5 having narrow side portions as indicated at numeral 5A.

An article of footwear in accordance with the present invention as described and illustrated hereinabove has a simple structure owing to the cushion member 9 of unitary construction disposed in the vacant space between the outer sole 2 and inner sole 6. The article of footwear therefore is easy to manufacture and assemble so that the associated costs can be reduced. The simple construction also assures that the interior of the footwear will be ventilated in reliable fashion. Furthermore, a ventilated article of footwear can be made lighter and therefore more comfortable to wear because the structure of the cushion member 9 is such that the material used for the construction thereof is considerably lighter than the material used to fabricate a pump member.

As many apparently widely different embodiments of the present invention can be made without departing from the spirit and scope thereof, it is to be understood that the invention is not limited to the specific embodiments thereof except as defined in the appended claims.

What is claimed is:

1. An article of footwear which comprises:

an upper;

an outer sole;

an inner sole affixed to said outer sole through the intermediary of said upper;

said inner sole and outer sole delimiting a vacant space therebetween;

said inner sole having a plurality of ventilating holes for communicating the vacant space with the interior of the article of footwear; and a cushion member, consisting of a light-weight resilient material, disposed on said outer sole in said vacant space;

said cushion member having a plurality of elongated ribs spaced apart by a predetermined distance and extending up to the vicinity of an arch supporting portion of the article of footwear;

each of said elongated ribs having at least one recessed portion of a predetermined depth passing completely through said elongated rib substantially laterally thereof, each recessed portion being approximately registered with one of said ventilating holes, each of said elongated ribs being provided, at each recessed portion thereof, with a substantially vertical bore having an upper end communicating with said recessed portion and having a lower end thereof and passing completely through said elongated rib substantially laterally thereof.

2. The article of footwear according to claim 1, in which said upper is provided with an air-permeable portion for passage of air between the interior and exterior of the article of footwear.

3. The article of footwear according to claim 2, in which said air-permeable portion comprises a mesh.

* * * * *